US006520716B2

(12) United States Patent
Röwer

(10) Patent No.: US 6,520,716 B2
(45) Date of Patent: Feb. 18, 2003

(54) PAVING SCREED FOR A PAVER

(75) Inventor: Helmut Röwer, Obernkirchen (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 0 days.

(21) Appl. No.: 09/917,055

(22) Filed: Jul. 27, 2001

(65) Prior Publication Data

US 2002/0041793 A1 Apr. 11, 2002

(30) Foreign Application Priority Data

Jul. 28, 2000 (DE) ..... 100 36 784

(51) Int. Cl.[7] ..... E01C 19/00; E01C 19/22
(52) U.S. Cl. ..... 404/104; 404/118
(58) Field of Search ..... 404/104, 118

(56) References Cited

U.S. PATENT DOCUMENTS 4,407,605 A * 10/1983 Wirtgen ..... 404/107
5,516,231 A * 5/1996 Heims et al. ..... 404/102
6,018,544 A * 2/2000 Emerson et al. ..... 404/104
6,022,170 A * 2/2000 Rower ..... 404/118
6,190,087 B1 * 2/2001 Rower ..... 403/31

* cited by examiner

*Primary Examiner*—Gary S. Hartmann
(74) *Attorney, Agent, or Firm*—Alix, Yale & Ristas, LLP

(57) ABSTRACT

The invention relates to a paving screed for a paver, with a basic screed and with at least one lateral extendable screed part which is connected to the basic screed via hydraulically actuable tensioners. The height of the extendable screed part can be adjusted via a height setting device which comprises vertical spindles which are coupled to the extendable screed part and are held on the basic screed rotatably relative to the latter. The spindles are adjustable via a common drive motor, it being possible, as a result of the actuation of the drive motor, to trigger a release of the hydraulically actuable tensioners for the duration of actuation. The extendable screed part is also connected to the basic screed via spring-biased screws.

8 Claims, 4 Drawing Sheets

PAVING SCREED FOR A PAVER

FIELD OF THE INVENTION

The invention relates to a paving screed for a paver used for road constructions and provided with a floating screed.

BACKGROUND OF THE INVENTION

In the case of pavers which are provided with a chassis and with a trailed floating paving screed which is articulated on the later via tension arms and of which the setting angle relative to the ground can be set via actuating cylinders and which comprises at least one ground-facing screed board, mix is introduced via a front hopper, is conveyed by means of a conveyer into the region in front of the paving screed and is distributed there over the width of the paving screed by means of a distributor auger, in order then to be paved by means of the paving screed.

For larger paving widths, a basic screed of the paving screed can be widened by extendable screed parts being extended and/or by screed lengthening parts being attached to the extendable screed part. It is known in this context that the extendable screed parts are manually adjustable in terms of their height with respect to the basic screed by means of spindles. However, this is complicated and time-consuming.

SUMMARY OF THE INVENTION

The object of the invention is to provide a paving screed with a possibility to adjust extendable screed parts in terms of their height relative to the basic screed in a convenient way.

According to the invention, spindles for adjusting the height of extendable screed parts are adjustable via a common drive motor, the actuation of the drive motor being able to release automatically for the duration of actuation hydraulically actuable tensioners via which the extendable screed is connected to the basic screed, whilst the extendable screed part is additionally connected to the basic screed via spring-biased screws, in such a way that it becomes possible for the height of the extendable screed part to be adjusted relative to the basic screed, but a clamping force is nevertheless exerted between these. Any play of the spindles, which could cause the spindle to swing, does not occur as a result. The hydraulically actuable tensioners are automatically tensioned again by terminating the actuation of the drive motor.

Further embodiments, advantages and objects of the invention will become apparent from the following description and from the claims.

BRIEF DESCRIPTION OF THE DRAWINGS

The invention is explained in more detail below with reference to an exemplary embodiment illustrated diagrammatically in the accompanying figures.

DETAILED DESCRIPTION OF A PREFERRED EMBODIMENT

Figure 1:
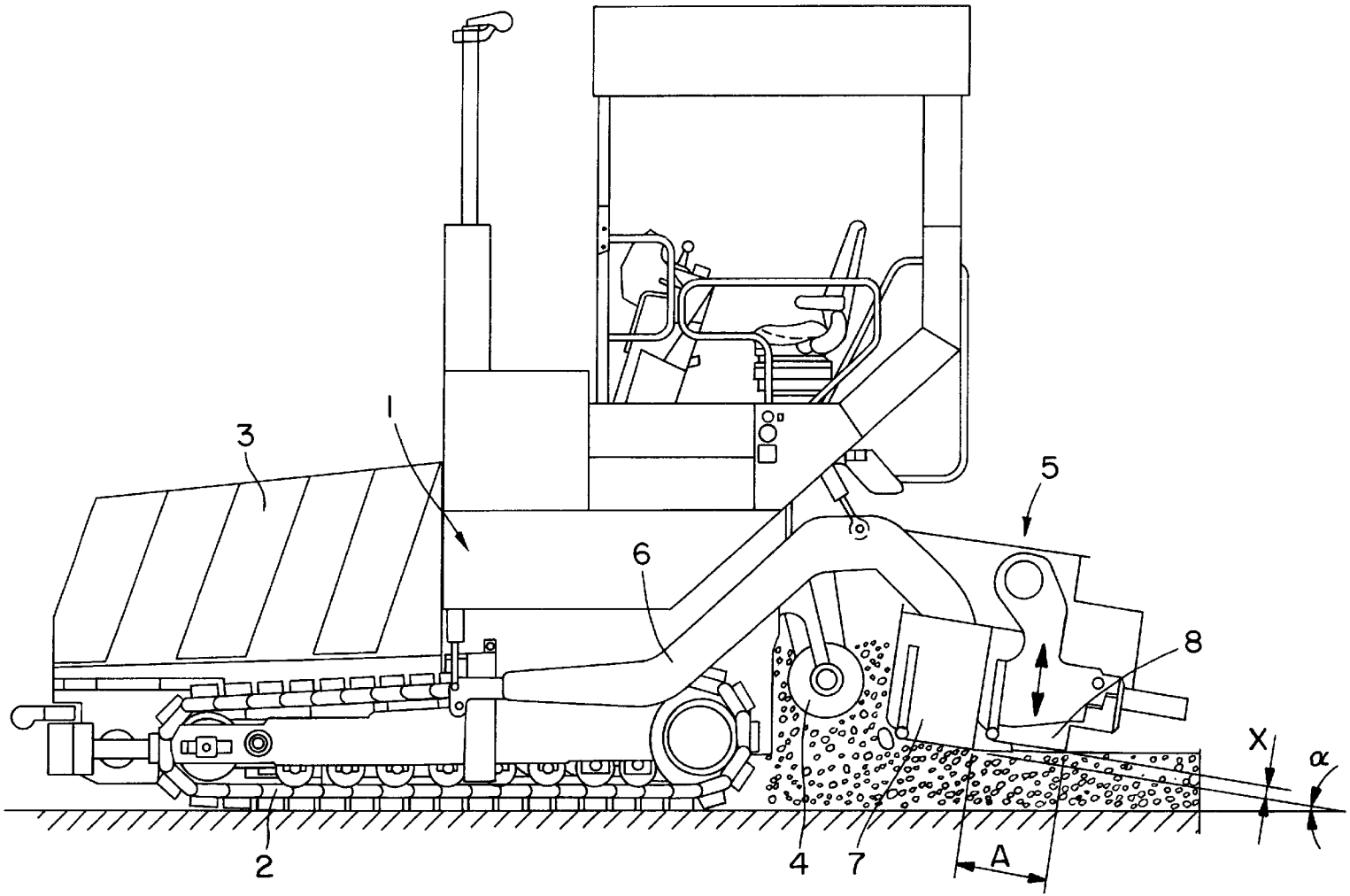
FIG. 1 shows a side view of a paver.

The paver illustrated in FIG. 1 comprises a chassis 1 with a crawler track assembly (wheel mechanisms may also be provided instead), the chassis 1 having at the front a hopper 3 and at the rear a distributor auger 4, between which a conveyer (which cannot be seen) is arranged for transporting mix to be paved out of the hopper 3 through a conveying shaft, above which superstructures are located, into the region of the distributor auger 4.

A floating paving screed 5 for the floating paving of the mix to be paved is articulated on the chassis I via tension arms 6. The paving screed 5 is located behind the region of the distributor auger 4 in the paving direction and may comprise a basic screed 7, if appropriate with extendable screeds 8 extendable laterally and independently of one another. The basic screed 7 is divided centrally in the conventional way, the two halves of the basic screed 7 being capable of being inclined relative to one another in order to set a roof profile transversely to the paving direction. The basic screed 7 can be widened to approximately double its width by means of the extendable screeds 8. If additional widening is also to be carried out, this is brought about by the screed lengthening parts (not illustrated in FIG. 1), which are capable of being attached manually to the extendable screeds 8. The extendable screeds 8 are generally offset relative to the basic screed 7 by a screed depth A, as seen in the paving direction.

Each tension arm 6 is articulated pivotably at its front end on the chassis 1, the height of the articulation point being capable of being adjusted relative to the chassis 1.

Figure 2:
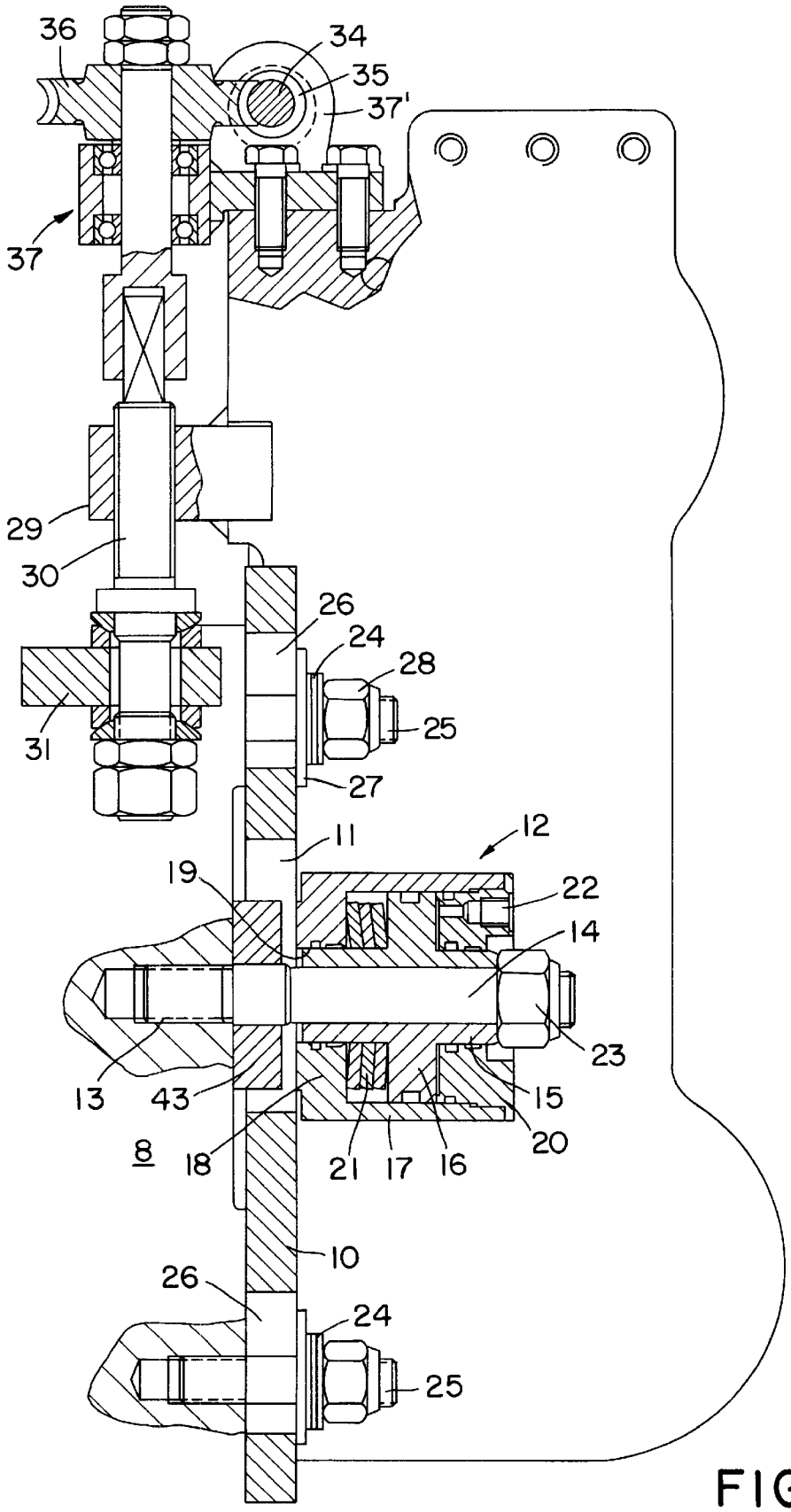
FIG. 2 shows diagrammatically, as a detail and partially in section, the region of abutment between the basic screed and the screed lengthening part.
Figure 3:
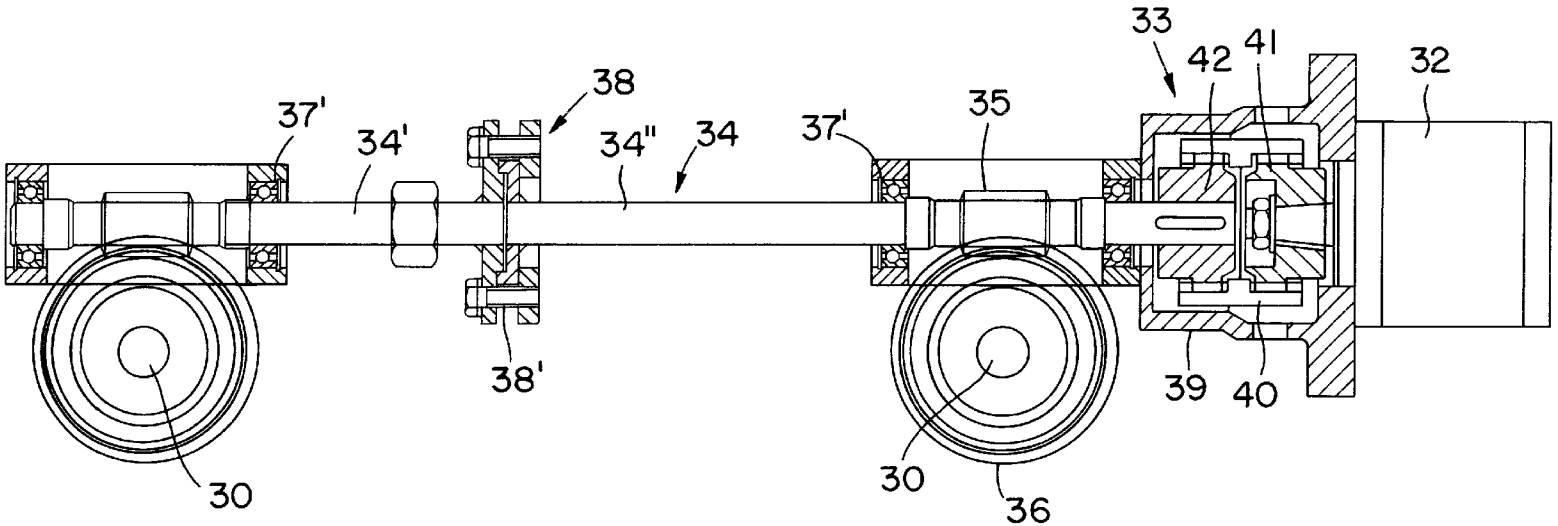
FIG. 3 shows a top view of an embodiment of a drive for adjusting the height of a screed lengthening part.
Figure 4:
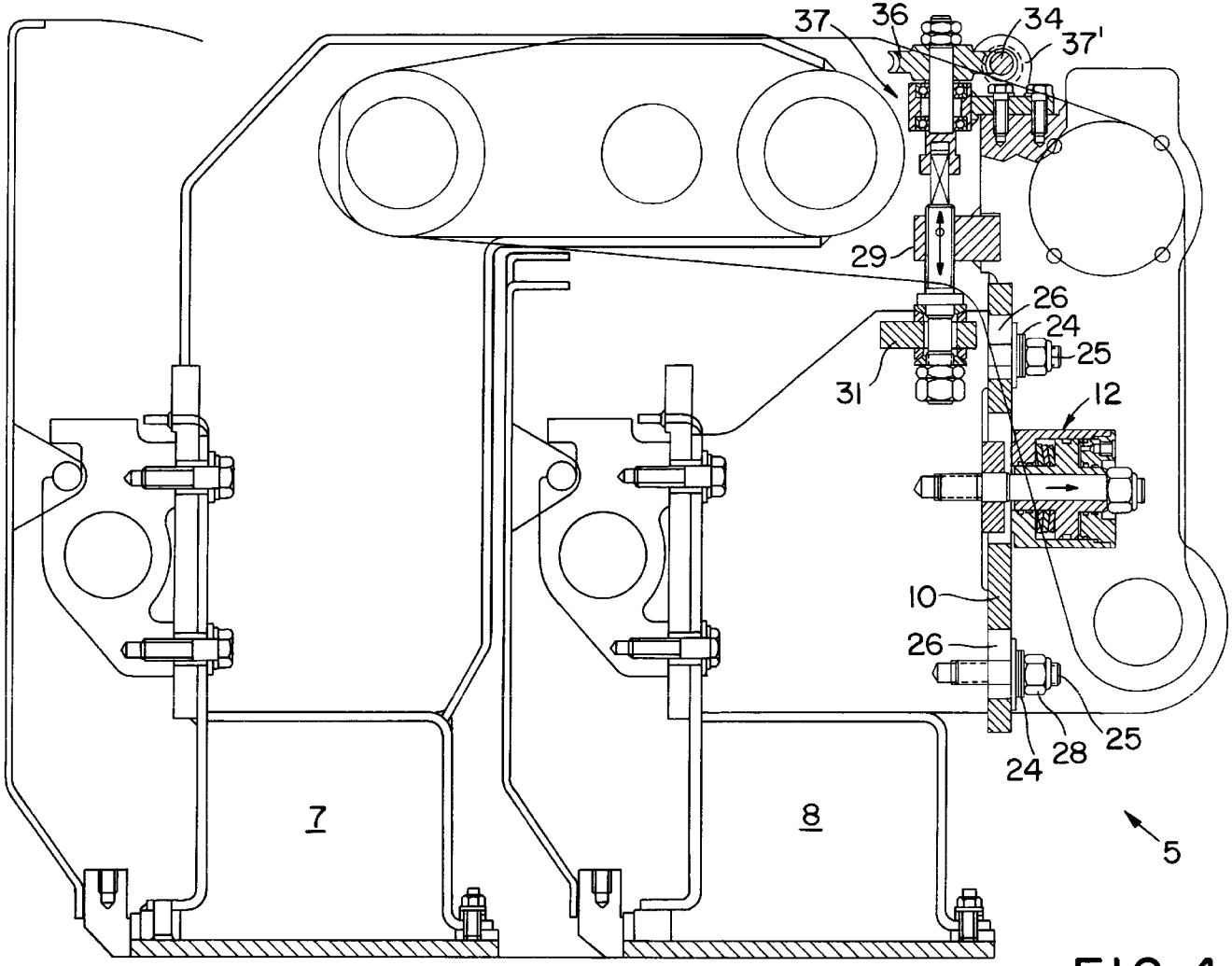
FIG. 4 shows diagrammatically a side view of a paving screed of a paver with cheeks for extension cylinders and guide rods.

As is evident from FIG. 2, an extendable screed part 8 is arranged adjacently to a cheek 10 of the basic screed 7, the cheek 10 having long holes 11 which serve for leading through hydraulically actuable tensioners 12, cf. for example, also U.S. Pat. Ser. No. 6,190,087 B1 which is incorporated herein by reference.

The hydraulically actuable tensioners 12 each possess a shank 14 provided on the end face with a thread 13, the thread 13 being in engagement with a corresponding threaded bore in the extendable screed part 8. Seated on the shank 14 is a piston 16 which comprises a guide sleeve 15 and which is arranged movably and in an appropriately sealed off manner within a cylinder housing 17. The cylinder housing 17 possesses, adjacent to the cheek 10, a bottom 18 with a bore 19, through which the shank 14 extends and into it the guide sleeve 15 extends. On the side opposite the bottom 18, the cylinder housing 17 is closed by means of a cover 20, through which the shank 14 and the guide sleeve 15 likewise extend. Between the piston 16 and the bottom 18 is arranged a cup-spring assembly 21 which biases the cylinder housing 17 relative to the piston 16. Hydraulic fluid can be introduced into the region between the piston 16 and the cover 20 via a bore 22 in the cover 20, in order to counteract the bias caused by the cup-spring assembly 21. The guide sleeve 15 comes to bear, on the side facing away from the bottom 18, against a self-locking nut 23 screwed onto the shank 14.

Without being subjected to pressure, the cup-spring assembly 21 tensions the cylinder housing 17 and, consequently, the screed lengthening part against the cheek 10. If, by contrast, the interspace between the piston 16 and the cover 20 is subjected to pressure, the cylinder housing 17 moves relative to the piston 16 and, consequently, to the shank 14, the cup-spring assembly 21 being compressed at the same time, so that the bias between the cheek 10 and the extendable screed part 8 is cancelled.

In addition, the extendable screed part 8 is connected to the cheek 10 by means of screws 25 which are biased by means of cup-springs 24 and the shanks of which are likewise led through long holes 26 in the cheek 10 and are screwed to the extendable screed part 8. The screws 25 are supported on the cheek 10 via washers 27 and expediently carry a self-locking nut 28.

Fastened to the basic screed 7 are two threaded bushes 29, through which extend vertically arranged spindles 30 provided with a thread. The spindles 30 are received rotatably at their lower end by a lug 31 fastened to the extendable screed part 8. By the spindles 30 being rotated, therefore, the height of the extendable screed part 8 can be adjusted relative to the basic screed 7.

The height adjustment of the extendable screed part 8 takes place via a preferably hydraulic drive motor 32, for example, a geared motor, which is connected to an output shaft 34 via a clutch 33. The output shaft 34 carries two worms 35, which are in engagement with corresponding worm wheels 36. The worm wheels 36 are in each case located on a shaft 37 which is mounted on the basic screed 7 via bearings 37 and which is in engagement with a respective spindle 30.

The shaft 34 expediently consists of two part-shafts 34', 34" which are in each case mounted on the two sides of the associated worm 35 by means of bearings 37' and are coupled to one another via a coupling 38.

A clutch housing 39 is provided and, in the exemplary embodiment illustrated, possesses an internally toothed clutch sleeve 40 which is in engagement, on the one hand, with a motor-side pinion 41 and, on the other hand, with a shaft-side pinion 42, in order to ensure a suitable connection.

When the drive motor 32 is actuated via a switch or the like (not illustrated), the switching of a valve (not illustrated) triggered thereby causes the hydraulic tensioners 12 to be subjected to hydraulic fluid and thereby released, whilst the screws 25 continue to brace the extendable screed part 8 together with the cheek 10. The height, and therefore also the inclination, of the extendable screed part 8 relative to the basic screed 7 can then be adjusted via the drive motor 32 as a result of the rotation of the spindles 30 which is brought about thereby, the spring bias of the screws 25 allowing this, but having the effect that the extendable screed part 8 is kept in bearing contact against the cheek 10. When the actuation of the drive motor 32 is terminated, the valve (not illustrated) for hydraulic fluid is changed over again, so that the tensioners 12 are no longer subjected to pressure and therefore once again brace the extendable screed part 8 against the cheek 10 in the now adjusted position.

The drive motor 32 can also be activated for the purpose of height adjustment by an appropriate controller, in which case this can then be dependent on the travel of the paver and therefore on the paving position or on the measured values from corresponding sensors.

The respective shank 14 expediently carries an essentially rectangular guide disc 43 which is vertically movable in the long hole 11 and which ensures lateral positioning between the extendable screed part 8 and the basic screed 7. This may, however, also be ensured by keyhole-like orifices in the cheek 10, instead of the long holes 11, when the width of the lower, narrow portion of these orifices corresponds essentially to the diameter of the shank 14.

It is also at the same time possible in a simple way to adjust only one spindle 30 of an extendable screed part 8 for the trimming of the latter, by screws 38' of the coupling 38 being released.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A paving screed for a paver, with a basic screed and with at least one lateral extendable screed part which is connected to the basic screed via hydraulically actuable tensioners and the height of the extendable screed part is adjustable by a height setting device, the height setting device comprising vertical spindles which are coupled to the extendable screed part and which are held on the basic screed rotatable relative to the extendable screed part, the spindles being adjustable via a common drive motor, the drive motor being actuatable to trigger a release of the hydraulically actuable tensioners for the duration of actuation and the extendable screed part being additionally connected to the basic screed via spring-biased screws.

2. The paving screed of claim 1, wherein the spindles are capable of being driven by the drive motor via a common shaft.

3. The paving screed of claim 2, wherein the shaft consists of two part-shafts mounted in each case on the end face and coupled to one another.

4. The paving screed of claim 1, wherein the spring-biased screws are provided with self-locking nuts.

5. The paving screed of claim 1, wherein the spindles are capable of being driven via worm gears.

6. The paving screed of claim 1, wherein the hydraulically actuable tensioners each have a shank which is screwed to the extendable screed part and which carries a piston which is spring-biased against a surrounding cylinder housing and can be subjected to hydraulic pressure counter to the spring bias.

7. The paving screed of claim 6, wherein the tensioners are guided in long holes on the basic screed via guide discs.

8. The paving screed of claim 1, wherein the spindle of an individual extendable screed part can be adjusted.

* * * * *